US007404704B2

(12) United States Patent
Kugelev et al.

(10) Patent No.: US 7,404,704 B2
(45) Date of Patent: Jul. 29, 2008

(54) MANIFOLD ASSEMBLY FOR RECIPROCATING PUMP

(75) Inventors: Vladimir Kugelev, Arlington, TX (US); Mark D. Matzner, Burleson, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 695 days.

(21) Appl. No.: 10/835,749

(22) Filed: Apr. 30, 2004

(65) Prior Publication Data

US 2004/0219042 A1 Nov. 4, 2004

Related U.S. Application Data

(60) Provisional application No. 60/466,604, filed on Apr. 30, 2003.

(51) Int. Cl.
*F04B 39/00* (2006.01)
*F04B 11/00* (2006.01)
*F04B 39/10* (2006.01)
*F04B 53/10* (2006.01)

(52) U.S. Cl. ..... 417/454; 417/539; 417/568

(58) Field of Classification Search ..... 417/454, 417/568, 569, 571, 539
See application file for complete search history.

(56) References Cited

U.S. PATENT DOCUMENTS 2,732,810 A * 1/1956 Simpson ..... 417/568
3,810,716 A 5/1974 Abrahams et al.
5,154,589 A * 10/1992 Ruhl et al. ..... 417/446
5,246,355 A * 9/1993 Matzner et al. ..... 417/521
5,584,672 A * 12/1996 Simonette ..... 417/307
5,636,975 A * 6/1997 Tiffany et al. ..... 417/454
5,839,468 A * 11/1998 Allred ..... 137/454.4
5,947,697 A 9/1999 Morrison
2004/0219042 A1 11/2004 Kugelev et al.

* cited by examiner

*Primary Examiner*—Devon Kramer
*Assistant Examiner*—Philip Stimpert
(74) *Attorney, Agent, or Firm*—Bracewell & Giuliani LLP

(57) ABSTRACT

A cylinder block assembly for a reciprocating pump includes a block body having a piston chamber that receives a piston of the reciprocating pump. The cylinder block assembly has an outlet valve assembly positioned within the block body that is positioned in fluid communication with the piston chamber. An outlet valve retainer retains the outlet valve relative to the piston chamber. The cylinder block assembly includes an inlet valve assembly extending through a side of the block body to the piston chamber. An inlet valve retainer also retains the inlet valve assembly relative to the piston chamber. A discharge passage extends from the outlet valve assembly to another side of the block body. A portion of the discharge passage extends between the inlet valve assembly and the inlet valve retainer.

20 Claims, 4 Drawing Sheets

MANIFOLD ASSEMBLY FOR RECIPROCATING PUMP

RELATED APPLICATIONS

This nonprovisional patent application claims the benefit of provisional patent application U.S. Ser. No. 60/466,604, filed on Apr. 30, 2003, which is hereby incorporated by reference in its entirety.

BACKGROUND OF THE INVENTION

1. Field of the Invention

The present invention relates generally to reciprocating pumps, and more specifically to a manifold assembly of an oil field mud or service pump.

2. Background of the Invention

In oil field operations, reciprocating pumps are often used for various purposes. Some reciprocating pumps are generally known as "service pumps" that are typically used for operations such cementing, acidizing, or fracing the well. Typically, these service pumps run for short periods of time, but on a frequent basis. Other reciprocating pumps, generally known as "mud pumps," are typically used for circulating drilling mud downhole through a drill string and back up to the surface along the outer surface of the drill string during drilling operations. Typically, these mud pumps run for long continuous periods of time.

A typical reciprocating pump has a fluid end block with an inlet and an outlet for fluid to enter and exit the pumping chambers. The piston chambers are horizontal. The inlet is typically located below the piston chambers, and is fed fluid from an inlet manifold attached below the piston chamber. Inlet valve assemblies generally extend vertically upward from a lower surface of the fluid end block, and into the piston chambers, to selectively open the inlets of the piston chambers.

Outlet valve assemblies also typically extend vertically down from the upper surface of the fluid end block to selectively open the outlet of the piston chamber. Each outlet valve assembly is generally coaxial with an inlet valve assembly. The outlet discharges the fluid to a discharge manifold. The vertical dimension of the fluid end is fairly large because the inlet valve assembly is located directly below the outlet assembly. In some installations, the amount of space for the fluid end is limited.

SUMMARY OF THE INVENTION

In this invention, a cylinder or fluid end block assembly for a reciprocating pump includes a block body. The block body defines a piston chamber adapted to receive a piston of the reciprocating pump. The cylinder block assembly has an outlet valve assembly positioned within the block body. The outlet valve assembly is positioned such that it is in fluid communication with the piston chamber. An outlet valve retainer retains the outlet valve relative to the piston chamber. The cylinder block assembly also includes an inlet valve assembly. The inlet valve assembly extends through a side of the block body to the piston chamber. An inlet valve retainer also retains the inlet valve assembly relative to the piston chamber. The cylinder block assembly also includes a discharge passage extending from the outlet valve assembly to another side of the block body. A portion of the discharge passage extends between the inlet valve assembly and the inlet valve retainer.

The cylinder block assembly can have an inlet valve assembly that includes a first flange and a second flange connected by a column. In this inlet valve assembly the column extends through the discharge passage. The first flange in such an assembly defines a first cross-sectional area while the second flange defines a second cross-sectional area. The first cross-sectional area is larger than the second cross-sectional area. The column defines a third cross-sectional area that is smaller than both the first and second cross-sectional areas defined by the first and second flanges.

The invention can also optionally include an inlet valve assembly having a spring-loaded valve extending from the second flange. The spring-loaded valve extends from the second flange through the piston chamber to an inlet of the piston chamber to selectively open and close the inlet of the piston chamber. The spring-loaded valve can include a valve member and a spring member. The spring member biases the valve member toward a closed position to sealingly engage the inlet of the piston chamber. The spring member actuates the valve member to an open position when the pressure differential across the valve member is larger than a predetermined amount. The first and second flanges, and the column remain stationary relative to the piston chamber so that the valve member moves relative to the second flange.

DETAILED DESCRIPTION OF THE PREFERRED EMBODIMENT

Figure 1:
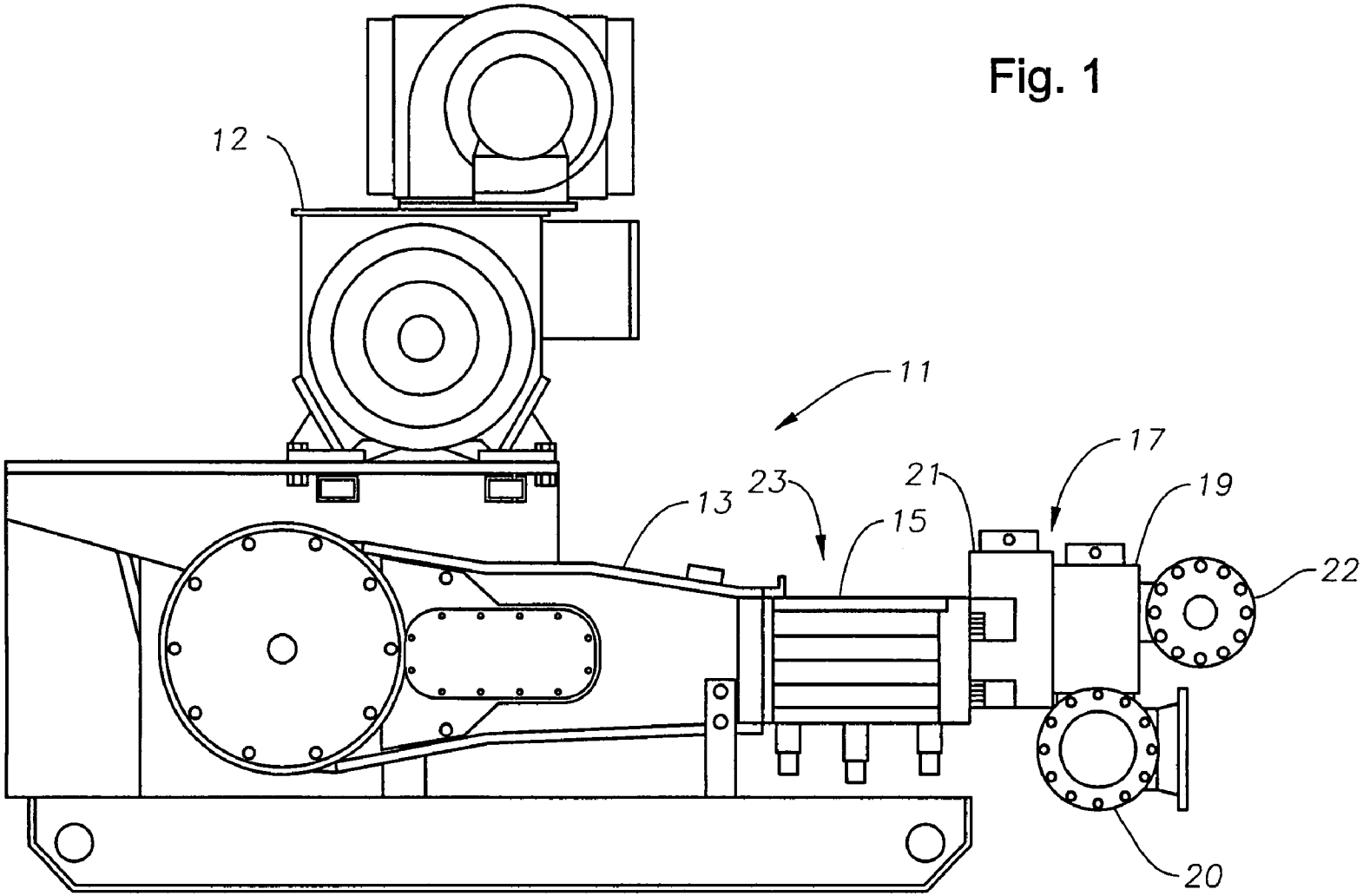
FIG. 1 is a schematic elevational view of a reciprocating pump assembly constructed in accordance with this invention.

Referring to FIG. 1, a reciprocating pump 11 includes a crankshaft housing 13 that comprises a majority of the outer surface of reciprocating pump 11 shown in FIG. 1. A motor 12, located adjacent crankshaft housing 13, drives reciprocating pump 11. Motor 12 optionally transfers rotational movement to pump 11 through belts, chains, gears, or a direct coupling. A plunger or piston rod housing 15 attaches to a side of crankshaft housing 13 and extends to a cylinder or fluid end block 17. Fluid end block 17 preferably includes a plurality of cylinders, each with a fluid inlet portion 19 and a fluid outlet portion 21.

Figure 2:
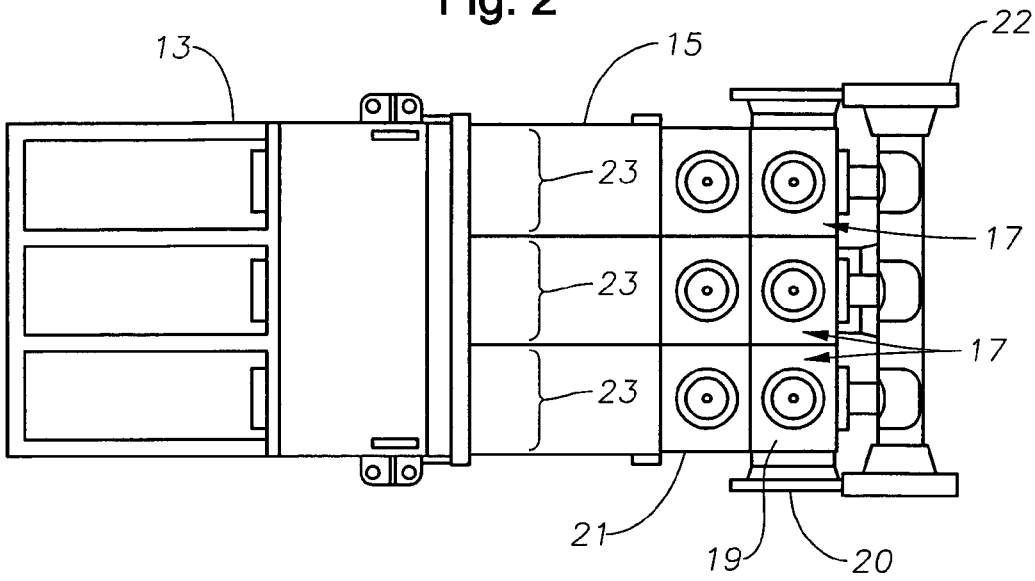
FIG. 2 is a top plan schematic view of the reciprocating pump assembly shown in FIG. 1.

Referring to FIG. 2, piston rod housing 15 has several portions, each portion comprising a plunger or piston throw 23. Reciprocating pump 11 as shown in FIG. 2 has three piston throws 23, which is commonly know as a triplex, but could also be segmented for five piston throws 23, which is commonly known as a quintuplex pump. The description focuses on a triplex pump, but as will be readily apparent to those skilled in the art, the features and aspects described are easily applicable for a quintuplex pump. Each piston throw 23 houses a pony rod 33 (FIG. 3), which connects to a piston 35 (FIG. 4) extending to fluid end 17. As shown in FIG. 2, each piston throw 23 extends in the same longitudinal direction from crankshaft housing 13.

Figure 3:
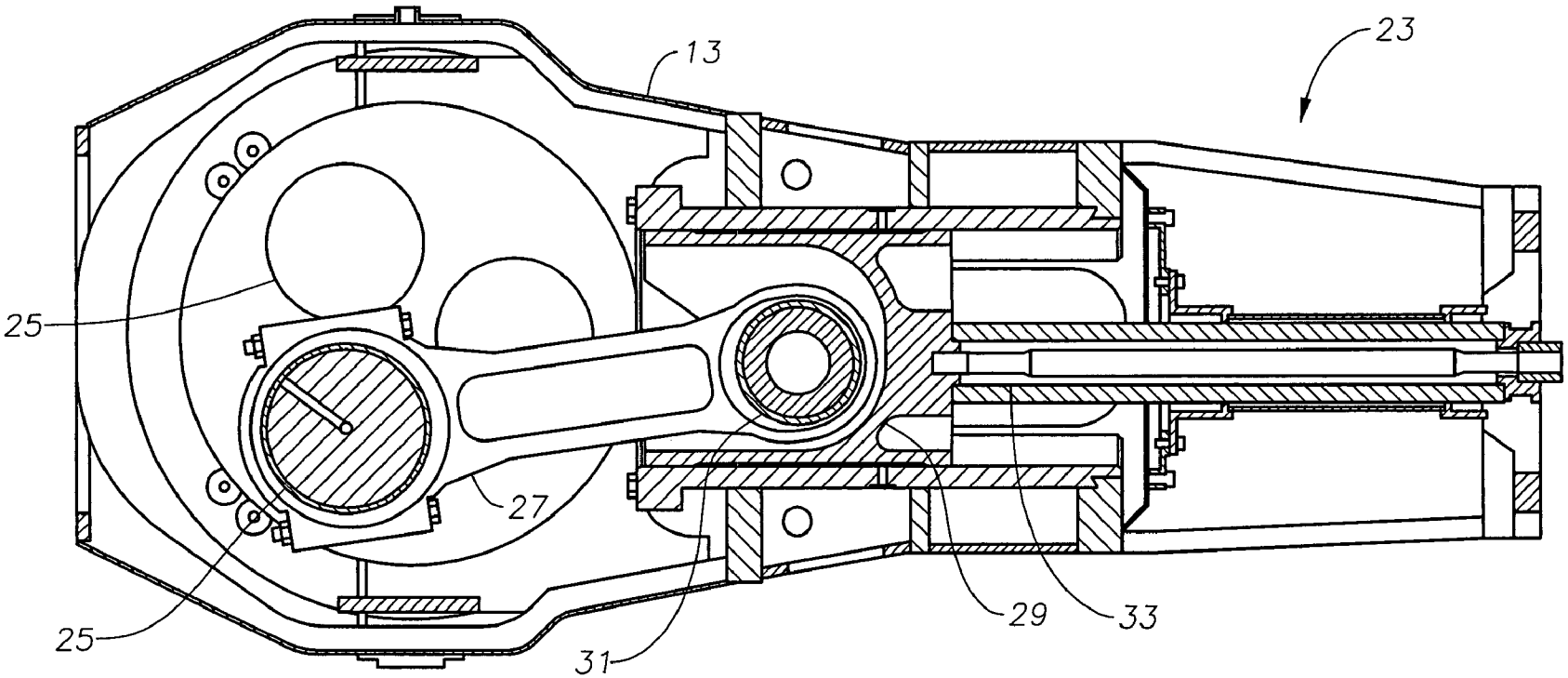
FIG. 3 is a sectional view of a portion of the pump assembly shown in FIG. 1.

Referring to FIG. 3, a portion of reciprocating pump 11 housed within crankshaft housing 13 is shown. Crankshaft housing 13 encloses a crankshaft 25, which is typically connected to motor 12 (FIG. 1). Motor 12 rotates crankshaft 25 in order to drive reciprocating pump 11. In the preferred embodiment, crankshaft 25 is cammed so that fluid is pumped from each piston throw 23 at alternating times. As is readily appreciable by those skilled in the art, alternating the cycles of pumping fluid from each of cylinders of fluid end 17 helps minimize the primary, secondary, and tertiary (et al.) forces associated with reciprocating pump 11. In the preferred embodiment, a connector rod 27 includes an end that connects to crankshaft 25 and another end that engages a crosshead 29. Connector rod 27 connects to crosshead 29 through a crosshead pin 31, which holds connector rod 27 longitudinally relative to crosshead 29. Connector rod 27 pivots about crosshead pin 31 as crankshaft 25 rotates with the other end of connector rod 27. Pony rod 33 extends from crosshead 29 in a longitudinally opposite direction from crankshaft 25. Connector rod 27 and crosshead 29 convert rotational movement of crankshaft 25 into longitudinal movement of pony rod 33.

Figure 4:
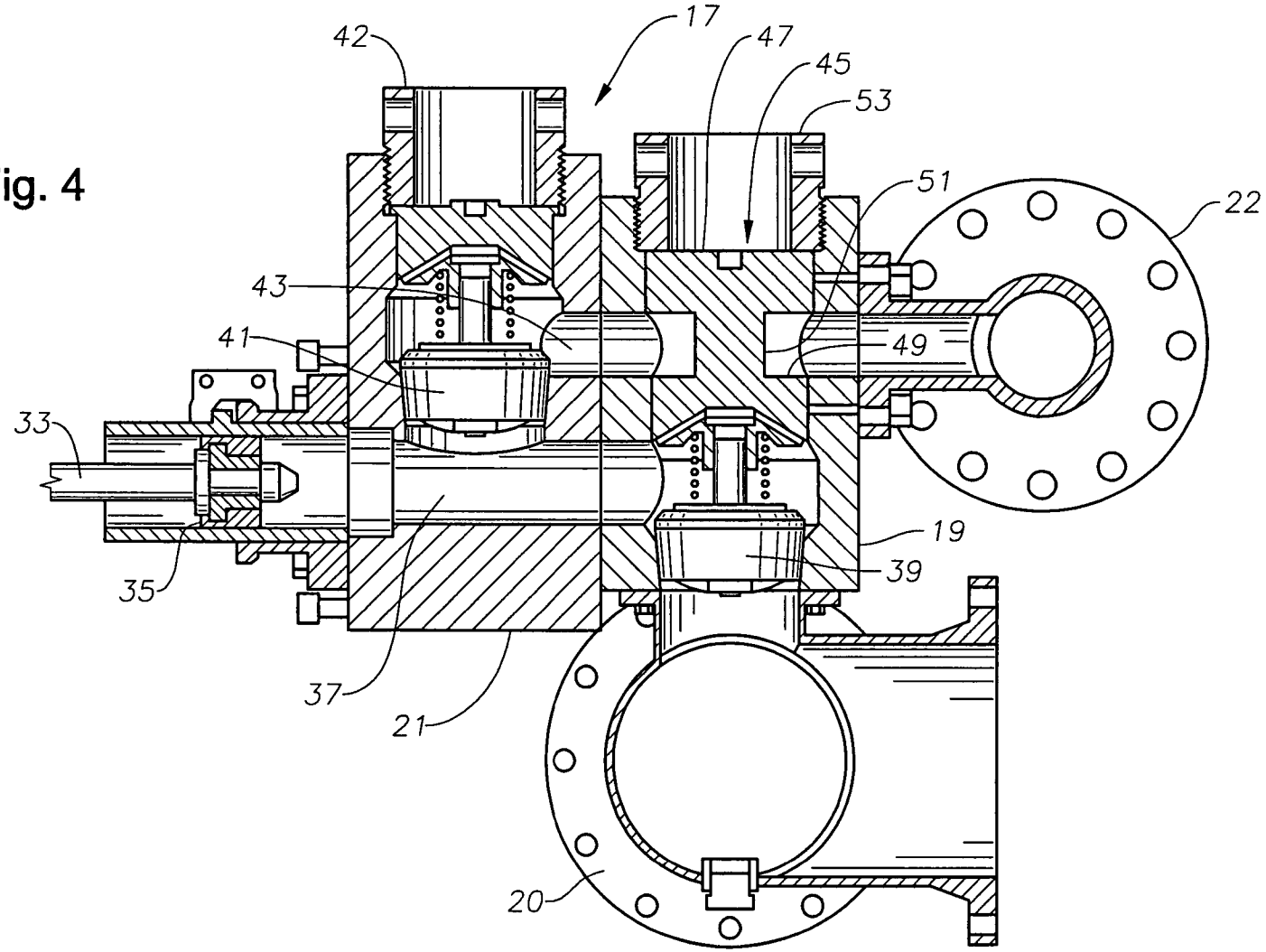
FIG. 4 is a sectional view of another portion of the pump assembly shown in FIG. 1.

Referring to FIG. 4, piston 35 connects to pony rod 33 for pumping the fluid passing through reciprocating pump 11. Fluid end 17 connects to the end of piston rod housing 15 that is opposite from crankshaft housing 13 (FIG. 1). Cylinder 17 typically includes a cylinder chamber 37, which is where the fluid being pumped by reciprocating pump 11 is pressurized by piston 35. Cylinder 17 preferably includes an inlet valve 39 and an outlet valve 41, with outlet valve 41 located rearward of inlet valve 39. Valves 39, 41 are preferably spring-loaded valves, which are actuated by a predetermined differential pressure. Inlet valve 39 actuates to control fluid flow through fluid inlet portion 19 into cylinder chamber 37, and outlet valve 41 actuates to control fluid flow through fluid outlet portion 21 from cylinder chamber 37. Inlet and outlet valves 39, 41 reciprocate on axes that are parallel to each other. An outlet valve retainer or threaded nut 42 engages a threaded bore formed in cylinder and holds outlet valve 41 in position relative to cylinder chamber 37. A discharge passage 43 extends through a side of fluid outlet portion 21 and through fluid inlet portion 19 to discharge manifold 22. In the preferred embodiment, discharge passage 43 is located above cylinder chamber 37 and extends in a substantially longitudinal direction from outlet valve 41 to discharge manifold 22.

In the preferred embodiment, inlet valve 39 is preferably an assembly that includes a suction or inlet valve cover or retainer 45 that is located substantially above cylinder chamber 37. Suction valve cover 45 is a spool-shaped member with a first flange or upper portion 47 and a second flange or lower portion 49 and a stem or column 51 extending therebetween. In the preferred embodiment, lower portion 49 has a height that is substantially the same as the portion of fluid inlet portion 19 located between discharge passage 43 and cylinder chamber 37. Column 51, extending above lower portion 49, preferably has a height that is substantially equal to the height of discharge passage 43 so that the lower edge of upper portion 47 is substantially flush with the upper edge of discharge passage 43. Column 51 preferably extends to a height that provides the portion of discharge passage 43 extending through inlet valve cover 45 with a cross-sectional area that is equal to or greater than the cross-sectional area of the other portions of discharge passage 43. In the preferred embodiment, an inlet valve retainer or threaded nut 53 having a threaded profile is positioned above upper portion 47, and engages a threaded profile on fluid inlet portion 19 to hold inlet valve cover 45 relative to discharge passage 43.

Figure 5:
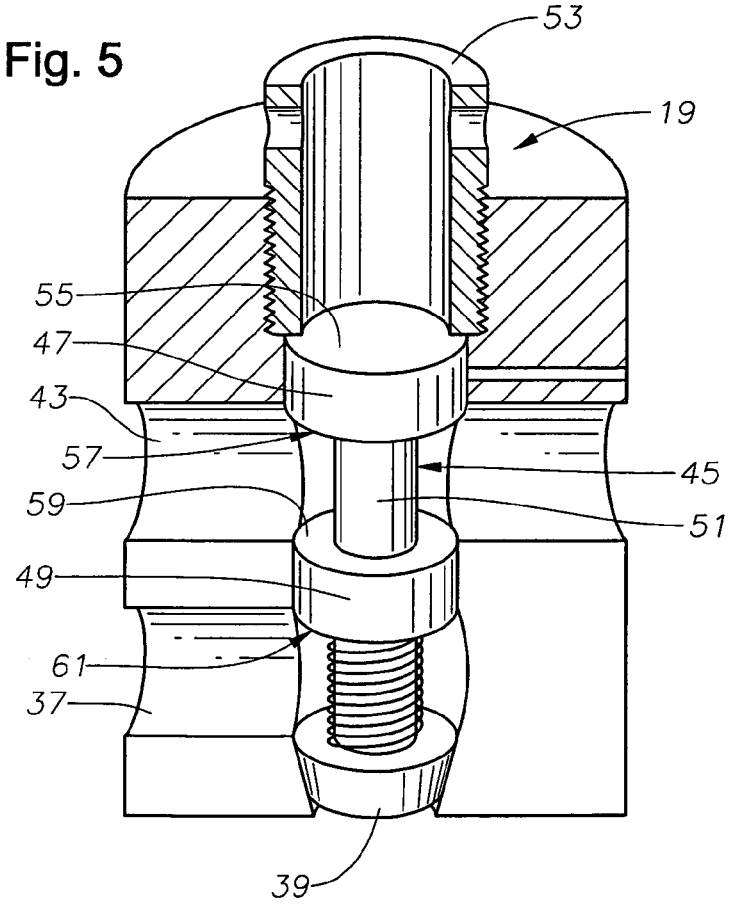
FIG. 5 is a partial sectional view of the fluid inlet portion of one of the cylinders in the pump assembly shown in FIG. 4.

As illustrated also in FIG. 5, upper portion 47 includes a top surface 55 and a bottom surface 57. Lower portion 49 also preferably includes a top surface 59 and a bottom surface 61. Column 51 extends between bottom surface 57 of upper portion 47 and top surface 59 of lower portion 49. As best illustrated in FIG. 5, upper portion 47, lower portion 49, and column 51 are all substantially cylindrically shaped, with each having their own respective diameters. In the preferred embodiment, upper portion 47 has a larger diameter than column 51 and lower portion 49, and lower portion 49 has a larger diameter than column 51. Fluid being pumped from cylinder chamber 37 through discharge passage 43 is allowed to flow between upper and lower portions 47 and 49 around column 51.

Piston 35 reciprocates, or moves longitudinally toward and away from cylinder 17, as crankshaft 25 rotates. As piston 35 moves longitudinally away from cylinder chamber 37, the pressure of the fluid inside chamber 37 decreases, creating a differential pressure across inlet valve 39, which actuates valve 39 and allows the fluid to enter cylinder chamber 37 through fluid inlet portion 19 from inlet manifold 20. The fluid being pumped enters cylinder chamber 37 as piston 35 continues to move longitudinally away from cylinder 17 until the pressure difference between the fluid inside chamber 37 and the fluid in fluid inlet manifold 20 is small enough for inlet valve 39 to actuate to its closed position. As piston 35 begins to move longitudinally toward cylinder 17, the pressure on the fluid inside of cylinder chamber 37 begins to increase. Fluid pressure inside cylinder chamber 37 continues to increase as piston 35 approaches cylinder 17 until the differential pressure across outlet valve 41 is large enough to actuate valve 41, which allows the fluid to exit cylinder 17 through discharge passage 43 extending through fluid outlet and inlet portions 21, 19. In the preferred embodiment, fluid is only pumped across one side of each piston 35, therefore reciprocating pump 11 is a single-acting reciprocating pump.

During operation, inlet valve cover 45 experiences both upward and downward forces from the fluid discharged from cylinder chamber 37 through discharge passage 43, however the net force on valve cover 45 during the suction and discharge strokes is upward. During discharge, bottom surface 57 of upper portion 47 experiences an upward force due to the fluid being discharged through discharge passage 43 around column 51, while top surface 59 of lower portion 49 experiences a downward force from the fluid being discharged through discharge passage 43 around column 51.

As mentioned above, in the preferred embodiment, upper portion 47 has a larger diameter than lower portion 49. The forces experienced on bottom surface 57 of upper portion 47 and top surface 59 of lower portion 49 are directly proportional to the surface area upon which the fluid discharge pressure in discharge passage 43 is applied. Due to the larger diameter of upper portion 47 compared to lower portion 49, the surface area upon which the fluid in discharge passage 43 applies pressure is larger. Therefore, the force upon upper portion 47 from the fluid in discharge passage 43 is larger than the downward force acting upon lower portion 49. Consequently, a net upward force is experienced by inlet valve cover 45 based upon the discharge fluid pressure located within discharge passage 43 flowing around column 51.

The combination of the upward force on the bottom surface 61 of lower portion 49, and the net upward force from the fluid being discharged in discharge passage 43 on inlet valve cover 45 is greater than the downward force applied on the top surface 55 of upper portion 47 during both suction and discharge cycles of reciprocating pump 11. Inlet valve cover 45 does not receive net oscillating forces as fluid is pumped into and out of cylinder chamber 37 because a net upward force biases inlet valve cover 45 in a generally upward direction during both suction and discharge cycles of reciprocating pump 11. Having a net upward force on inlet valve cover 45 during both suction and discharge strokes of piston 35 thereby reduces wear, and increases the reliability and efficiency of reciprocating pump 11.

Offsetting the discharge and suction valves reduces the height of the fluid end. Also, the suction valves can be accessed without removing the discharge valves.

While the invention has been shown in only one of its forms, it should be apparent to those skilled in the art that it is not so limited, but is susceptible to various changes without departing from the scope of the invention. For example, inlet valve cover 45 and threaded nut 53 could be combined to form a single part as opposed to two independent parts which would perform substantially the same function as inlet valve cover 45 described above.

The invention claimed is:

1. A cylinder block assembly for a reciprocating pump, comprising:

a block body defining a piston chamber adapted to receive a piston of a reciprocating pump;

an outlet valve assembly positioned within the block body and having an outlet valve actuation axis in fluid communication with the piston chamber;

an outlet valve retainer that retains the outlet valve relative to the piston chamber;

an inlet valve assembly positioned within the block body and having an inlet valve actuation axis in fluid communication with the piston chamber, the inlet valve actuation axis being parallel to and non-coaxial with the outlet valve actuation axis;

an inlet valve retainer that retains the inlet valve assembly relative to the piston chamber; and a discharge passage extending from the outlet valve assembly to a side of the block body, a portion of the discharge passage extending between the inlet valve assembly and the inlet valve retainer.

2. The cylinder block assembly of claim 1, wherein the inlet valve retainer further comprises a first flange and a second flange connected by a column, the column extending through the discharge passage.

3. The cylinder block assembly of claim 2, wherein the first flange defines a first cross-sectional area and the second flange defines a second cross-sectional area, the first cross-sectional area being larger than the second cross-sectional area.

4. The cylinder block assembly of claim 3, wherein the column defines a third cross-sectional area that is smaller than both the first and second cross-sectional areas defined by the first and second flanges.

5. The cylinder block assembly of claim 2, wherein the inlet valve retainer further comprises a threaded member that matingly engages the block body and engages an upper surface of the first flange to retain the inlet valve assembly.

6. The cylinder block assembly of claim 2, wherein the discharge passage defines a passage height and the column of the inlet valve assembly has a longitudinal length that is substantially the same as the passage height.

7. The cylinder block assembly of claim 1, wherein the inlet valve retainer comprises a threaded valve cover secured to the block body and a spool-shaped member extending from the inlet valve assembly through the discharge passage to the valve cover.

8. The cylinder block assembly of claim 1, wherein the inlet valve assembly and the inlet valve retainer extend through the block body from an upper side of the block body to an inlet of the piston chamber located at a lower side of the block body.

9. The cylinder block assembly of claim 1, wherein the block body further comprises an inlet portion that houses the inlet valve assembly and an outlet portion that houses the outlet valve assembly, the outlet portion having a first sidewall that is adapted to connect to the reciprocating pump and a second sidewall connected to the inlet portion.

10. The cylinder block assembly of claim 9, wherein the discharge passage extends away from the first sidewall and through the inlet portion of the block body.

11. In a reciprocating pump assembly having a pump housing that houses a crankshaft, a plurality of pistons mechanically connected to the crankshaft for pumping a fluid through a cylinder block, the cylinder block defining a cylindrical piston chamber for each of the pistons that receives fluid from an inlet manifold and a fluid outlet that conveys fluid to an outlet manifold, the reciprocating pump, comprising:

a plurality of outlet valves associated with and being in fluid communication with each respective piston chamber defined by the cylinder block, which actuate along a respective outlet valve axis to an open position when an outlet valve fluid pressure differential exceeds a predetermined outlet valve differential across respective ones of the outlet valves;

a plurality of inlet valves extending through a side of the cylinder block portion to each of respective ones of the piston chambers, which actuate along a respective inlet valve axis to an open position when an inlet valve fluid pressure differential exceeds a predetermined inlet valve differential across respective ones of the inlet valves, the inlet valve axes being parallel to and offset from respective ones of the outlet valve axes;

a plurality of discharge passages extending from respective ones of the outlet valves to the outlet manifold; and an inlet valve retainer for each of the inlet valves that retains respective ones of the inlet valves relative to respective ones of the piston chambers, each of the inlet valve retainers extending along respective ones of the inlet valve axes and through respective ones of the discharge passages.

12. The reciprocating pump assembly of claim 11, wherein each of the inlet valves comprises a spring loaded valve having an actuating member that selectively engages an inlet of a respective one of the piston chambers, and a spring member that biases the actuating member toward a closed position.

13. The reciprocating pump assembly of claim 11, wherein each of the inlet valve retainers comprises a spool-shaped member with a first flange and a second flange connected by a column, so that the column extends through a respective one of the discharge passages.

14. The reciprocating pump assembly of claim 13, wherein the first flange defines a first cross-sectional area and the second flange defines a second cross-sectional area, the first cross-sectional area being larger than the second cross-sectional area.

15. The reciprocating pump assembly of claim 14, wherein each of the inlet valves comprises a spring loaded valve having an actuating member that selectively engages an inlet of a respective one of the piston chambers, and a spring member that engages the second flange in order to bias the actuating member toward a closed position.

16. The reciprocating pump assembly of claim 13, wherein each of the discharge passages defines a passage height and the column of a respective one of the inlet valves has a longitudinal length that is substantially the same as the passage height.

17. The reciprocating pump assembly of claim 13, wherein a lower surface of each of the second flanges defines a portion of an inner surface of a respective one of the piston chambers.

18. The reciprocating pump assembly of claim 13, wherein an upper surface of each of the second flanges and a lower surface of each of the first flanges define upper and lower portions, respectively, of an inner surface of respective ones of the discharge passages.

19. A cylinder block assembly for a reciprocating pump, comprising:

a block body defining a piston chamber having an inlet and an outlet, the piston chamber being adapted to receive a piston of the reciprocating pump;

an inlet valve within an inlet passage extending through the block body to the piston chamber;

an inlet valve retainer comprising a first flange, a second flange and a column extending between the first and second flanges, the inlet valve being in engagement with the second flange;

an outlet valve assembly having an outlet valve actuation axis;

a threaded member having a threaded profile formed on its outer circumference that engages a threaded profile on the block body, and the block body engages the first flange to retain the inlet valve retainer relative to the piston chamber; and a discharge passage extending from the outlet of the piston chamber to a side of the block body, a portion of the discharge passage extending around the column between the first and second flanges of the inlet valve retainer, wherein the inlet valve has an inlet valve actuation axis which is parallel to an non-coaxial with the outlet valve actuation axis.

20. The cylinder block assembly of claim 19, wherein the first flange defines a first cross-sectional area and the second flange defines a second cross-sectional area, the first cross-sectional area being larger than the second cross-sectional area.

* * * * *